US011145255B1

(12) United States Patent
Lee

(10) Patent No.: US 11,145,255 B1
(45) Date of Patent: Oct. 12, 2021

(54) PIXEL CIRCUITS FOR LIGHT EMITTING ELEMENTS TO MITIGATE DEGRADATION

(71) Applicant: Shanghai Yunyinggu Technology Co., Ltd., Shanghai (CN)

(72) Inventor: Chu Rung Lee, Zhubei (TW)

(73) Assignee: SHANGHAI YUNYINGGU TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/834,689

(22) Filed: Mar. 30, 2020

(51) Int. Cl.
*G09G 3/3258* (2016.01)
*G09G 3/3241* (2016.01)

(52) U.S. Cl.
CPC ..... *G09G 3/3258* (2013.01); *G09G 3/3241* (2013.01); *G09G 2310/0272* (2013.01); *G09G 2320/043* (2013.01)

(58) Field of Classification Search
CPC ..... G09G 3/3233–3258; G09G 2320/043
See application file for complete search history.

(56) References Cited

U.S. PATENT DOCUMENTS

2006/0244695 A1* 11/2006 Komiya ..... G09G 3/006 345/76
2008/0117196 A1* 5/2008 Lee ..... G09G 3/3225 345/208

FOREIGN PATENT DOCUMENTS

| | | | |
|---|---|---|---|
| CN | 1345021 | A | 4/2002 |
| CN | 1499471 | A | 5/2004 |
| CN | 101996580 | A | 3/2011 |
| CN | 104392689 | A | 3/2015 |
| CN | 107068059 | A | 8/2017 |
| CN | 111161674 | A | 5/2020 |
| KR | 2008113528 | A | 11/2008 |
| KR | 20100054563 | A | 5/2010 |

OTHER PUBLICATIONS

International Search Report and Written Opinion from corresponding PCT Application No. PCT/CN2021/081032 dated Jun. 16, 2021 (10 pages).

* cited by examiner

*Primary Examiner* — Laurence J Lee
(74) *Attorney, Agent, or Firm* — Bayes PLLC

(57) ABSTRACT

Embodiments of pixel circuits for light emitting elements are disclosed herein. In one example, a pixel circuit includes a pixel driver configured to receive a data signal and drive a light emitting element based on the data signal, a first power signal coupled to an anode of the light emitting element through the pixel driver, and a second power signal coupled to a cathode of the light emitting element. In some embodiments, the second power signal is configured to vary based on the data signal. In some embodiments, in a first period of the data signal, a value of the second power signal is configured to be lower than a value of first power signal, and in a second period of the data signal, the value of the second power signal is configured to be higher than the value of the first power signal.

19 Claims, 14 Drawing Sheets

PIXEL CIRCUITS FOR LIGHT EMITTING ELEMENTS TO MITIGATE DEGRADATION

BACKGROUND

The disclosure relates generally to display technologies, and more particularly, to pixel circuits.

In a display formed by organic light emitting diodes (OLEDs), when a voltage is applied on the anode and cathode of an OLED, holes injected from the anode and electrons injected from the cathode are combined in a light emitting layer of the OLED, emitting light. When an OLED is under continuous forward bias, impurity ions can migrate, and electric dipoles can move from their original positions. These changes in the OLEDs can form an electric field of the opposite direction than that formed by the voltage. The driving current and brightness of the OLEDs can decrease, causing degeneration in the OLEDs.

SUMMARY

Embodiments of pixel circuits for light emitting elements are disclosed herein.

In one example, a pixel circuit includes a pixel driver configured to receive a data signal and drive a light emitting element based on the data signal, a first power signal coupled to an anode of the light emitting element through the pixel driver, and a second power signal coupled to a cathode of the light emitting element. In some embodiments, the second power signal is configured to vary based on the data signal. In some embodiments, in a first period of the data signal, a value of the second power signal is configured to be lower than a value of first power signal, and in a second period of the data signal, the value of the second power signal is configured to be higher than the value of the first power signal.

In another example, a circuit for driving a plurality of light emitting elements includes a plurality of pixel circuits, each of the plurality of pixel circuits configured to drive one of a plurality of light emitting elements arranged in a plurality of rows and a plurality of columns. Each of the pixel circuits includes a pixel driver configured to receive a data signal and drive a light emitting element based on the data signal, a first power signal coupled to an anode of the light emitting element through the pixel driver, and a second power signal coupled to a cathode of the light emitting element. In some embodiments, the second power signal is configured to vary based on the data signal. In some embodiments, in a first period of the data signal, a value of the second power signal is lower than a value of first power signal, and in a second period of the data signal, the value of the second power signal is higher than the value of the first power signal.

In still another example, a circuit for driving a light emitting element includes an alternating current (AC) power source circuit having a first power circuit configured to output a first power signal and a second power circuit configured to output a second power signal. In some embodiments, the first power signal ranges between a first high power value and a first low power value, the first high power value being greater than the first low power value; the second power signal ranges between a second high power value and a second low power value, the second high power value being greater than the second low power value; and a power swing value of the AC power source circuit is equal to a difference between the first high power value and the second low power value. The difference is equal to or greater than a driving voltage across the light emitting element.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
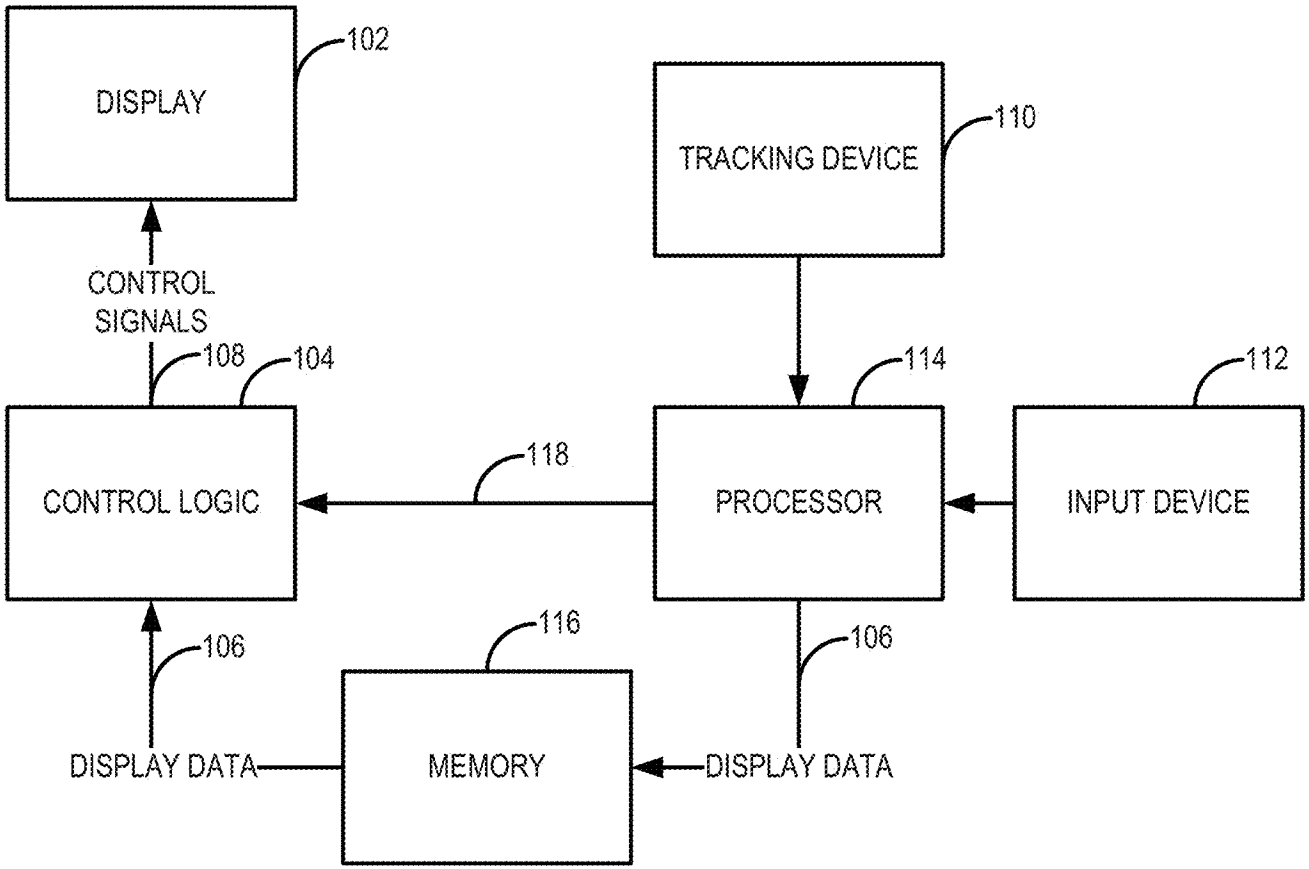
FIG. 1 is a block diagram illustrating an apparatus including a display and control logic in accordance with an embodiment.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

Although specific configurations and arrangements are discussed, it should be understood that this is done for illustrative purposes only. It is contemplated that other configurations and arrangements can be used without departing from the spirit and scope of the present disclosure. It is further contemplated that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it is contemplated that such feature, structure or characteristic may also be used in connection with other embodiments whether or not explicitly described.

In general, terminology may be understood at least in part from usage in context. For example, the term "one or more"

as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As will be disclosed in detail below, among other novel features, the pixel circuits for light emitting elements disclosed herein can increase the voltage at the cathodes of the light emitting elements to result in the light emitting elements to be reversely biased when they are turned off, modifying the electrical fields in the light emitting elements. This operation can reduce or alleviate degeneration in the light emitting elements, as well as improve the contrast ratio of the display. In some embodiments, the voltage at the anodes of the light emitting diodes is decreased when the light emitting elements are turned off, allowing the reverse bias applied on the light emitting diodes to be determined more flexibly.

In the present disclosure, the first and second power signals applied on the anodes and the cathodes of the light emitting diodes can be applied on the light emitting diodes in at least one row. In some embodiments, each row of light emitting elements is applied with a respective first/second power signal. In some embodiments, the light emitting elements in the entire display are applied with the same first/second power signal. The first/second power signals can each be generated by a respective power source circuit, which has a voltage swing range, allowing the light emitting elements to be reversely biased with higher flexibility. Meanwhile, the power source circuits are coupled to the capacitors for filtering out noises only when the light emitting elements are forwardly biased for emitting light, reducing energy consumption. Compared to conventional pixel circuits, in which power signals are applied only to control the "ON" and "OFF" states of the light emitting elements (e.g., not to be reversely biased), the disclosed pixel circuits can reversely bias the light emitting elements with the power signals or an external signal, preventing/reducing floating anode of the light emitting elements and light emission caused by leakage current. The degeneration of the light emitting elements can be reduced or prevented.

FIG. 1 illustrates an apparatus 100 including a display 102 and control logic 104. Apparatus 100 may be any suitable device, for example, a virtual reality (VR), augment reality (AR), or mixed reality (MR) device (e.g., VR headset, etc.), handheld device (e.g., dumb or smart phone, tablet, etc.), wearable device (e.g., eyeglasses, wrist watch, etc.), automobile control station, gaming console, television set, laptop computer, desktop computer, netbook computer, media center, set-top box, global positioning system (GPS), electronic billboard, electronic sign, printer, or any other suitable device. In this embodiment, display 102 is operatively coupled to control logic 104 and is part of apparatus 100, such as but not limited to, an HMD, handheld device screen, computer monitor, television screen, dashboard, electronic billboard, or electronic sign. Display 102 may be an OLED display, micro-LED display, liquid crystal display (LCD), E-ink display, electroluminescent display (ELD), billboard display with LED or incandescent lamps, or any other suitable type of display.

Control logic 104 may be any suitable hardware, software, firmware, or a combination thereof, configured to receive display data 106 (e.g., pixel data) and generate control signals 108 for driving the subpixels on display 102. Control signals 108 are used for controlling the writing of display data 106 to the subpixels and directing operations of display 102. For example, subpixel rendering (SPR) algorithms for various subpixel arrangements may be part of control logic 104 or implemented by control logic 104. Control logic 104 may be implemented as a standalone integrated circuit (IC) chip, such as an application-specific integrated circuit (ASIC) or a field-programmable gate array (FPGA). Apparatus 100 may also include any other suitable components, such as but not limited to tracking devices 110 (e.g., inertial sensors, camera, eye tracker, GPS receiver, or any other suitable devices for tracking motion of eyeballs, facial expression, head movement, body movement, and hand gesture), input devices 112 (e.g., a mouse, keyboard, remote controller, handwriting device, microphone, scanner, etc.), and speakers (not shown).

In this embodiment, apparatus 100 may be a handheld or a VR/AR/MR device, such as a smart phone, a tablet, or a VR headset. Apparatus 100 may also include a processor 114 and memory 116. Processor 114 may be, for example, a graphics processor (e.g., graphics processing unit (GPU)), an application processor (AP), a general processor (e.g., APU, accelerated processing unit; GPGPU, general-purpose computing on GPU), or any other suitable processor. Memory 116 may be, for example, a discrete frame buffer or a unified memory. Processor 114 is configured to generate display data 106 in display frames and may temporally store display data 106 in memory 116 before sending it to control logic 104. Processor 114 may also generate other data, such as but not limited to, control instructions 118 or test signals, and provide them to control logic 104 directly or through memory 116. Control logic 104 then receives display data 106 from memory 116 or from processor 114 directly.

Figure 2:
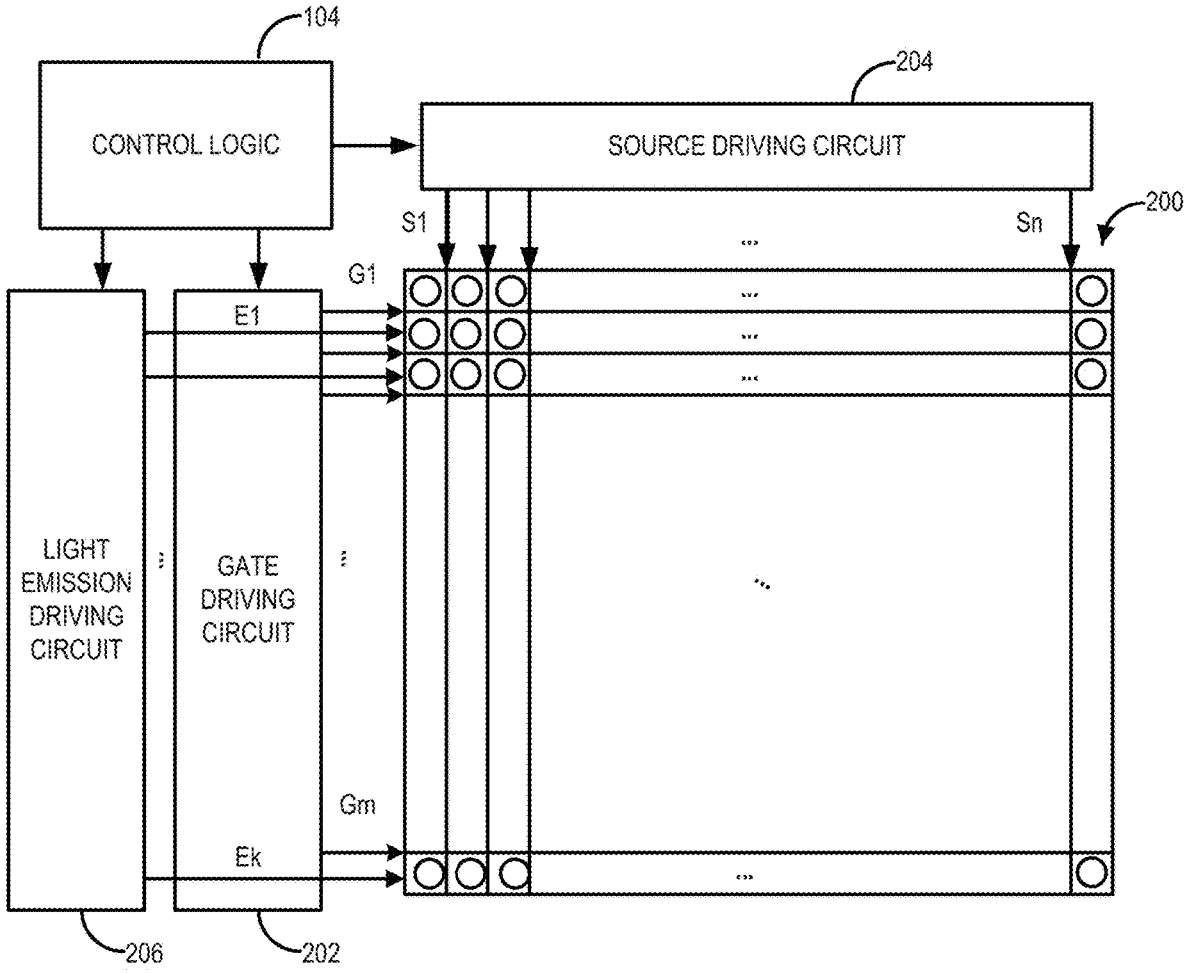
FIG. 2 is a block diagram illustrating the display shown in FIG. 1 including driving circuits in accordance with an embodiment.

FIG. 2 is a block diagram illustrating display 102 shown in FIG. 1 including driving circuits in accordance with an embodiment. Display 102 in this embodiment includes a display panel having an active region 200 including a plurality of subpixels. The display panel may also include on-panel driving circuits, e.g., a gate driving circuit 202 and a source driving circuit 204. It is to be appreciated that in some embodiments, gate driving circuit 202 and source driving circuit 204 may not be on-panel driving circuits, i.e., not parts of the display panel, but instead are operatively coupled to the display panel.

Each subpixel may be any of the units that make up a pixel, i.e., a subdivision of a pixel. For example, a subpixel may be a single-color display element that can be individually addressed. In some embodiments in which display 102 is a light emitting element display (e.g., an OLED display or a micro-LED display), each subpixel may include a light emitting element (e.g., an OLED or a micro-LED) and a pixel circuit for driving the light emitting element. The plurality of subpixels (and the light emitting elements thereof) may be arranged in an array having a plurality of rows and columns according to any suitable subpixel arrangement. Each light emitting element can emit light in a predetermined brightness and color, such as but not limited to, red, green, blue, yellow, cyan, magenta, or white. Each pixel circuit includes thin film transistors (TFTs) and capacitor(s) and is configured to drive the corresponding subpixel by controlling the light emitting from the respective light emitting element according to control signals 108 from control logic 104. The pixel circuit may be in a 2T1C configuration (i.e., including a switching transistor, a driving transistor, and a storage capacitor) or may include a compensation circuit with more transistors and/or capacitors for brightness uniformity, such as in a 7T1C, 5T1C, 5T2C, or 6T1C configuration.

Gate driving circuit 202 in this embodiment is operatively coupled to active region 200 via a plurality of gate lines G1-Gm (a.k.a. scan lines) and configured to scan the plurality of subpixels. For example, gate driving circuit 202 applies a plurality of scan signals, which are generated based on control signals 108 from control logic 104, to the plurality of gate lines G1-Gm for scanning the plurality of subpixels in a gate scanning order. A scan signal is applied to the gate electrode of a switching transistor of each pixel circuit during the scan period to turn on the switching transistor so that the data signal for the corresponding subpixel can be written by source driving circuit 204. It is to be appreciated that although one gate driving circuit 202 is illustrated in FIG. 2, in some embodiments, multiple gate driving circuits may work in conjunction with each other to scan the subpixels.

Source driving circuit 204 in this embodiment is operatively coupled to active region 200 via a plurality of source lines S1-Sn (a.k.a. data lines) and configured to write display data 106 in frames to the plurality of subpixels. For example, source driving circuit 204 may simultaneously apply a plurality of data signals to the plurality of source lines S1-Sn for the subpixels. That is, source driving circuit 204 may include one or more shift registers, digital-analog converters (DAC), multiplexers (MUX), and arithmetic circuit for controlling a timing of application of voltage to the source electrode of the switching transistor of each pixel circuit (i.e., during the scan period in each frame) and a magnitude of the applied voltage according to gradations of display data 106. It is to be appreciated that although one source driving circuit 204 is illustrated in FIG. 2, in some embodiments, multiple source driving circuits may work in conjunction with each other to apply the data signals to the source lines for the subpixels.

Additionally, a light emission driving circuit 206 may be included on the display panel. Light emission driving circuit 206 may be operatively coupled to active region 200 and configured to cause each subpixel to emit light for a certain time period in each frame by applying a plurality of light emission signals to a plurality of emission lines E1-Ek. It is to be appreciated that although one light emission driving circuit 206 is illustrated in FIG. 2, in some embodiments, multiple light emission driving circuits may work in conjunction with each other.

Figure 3A:
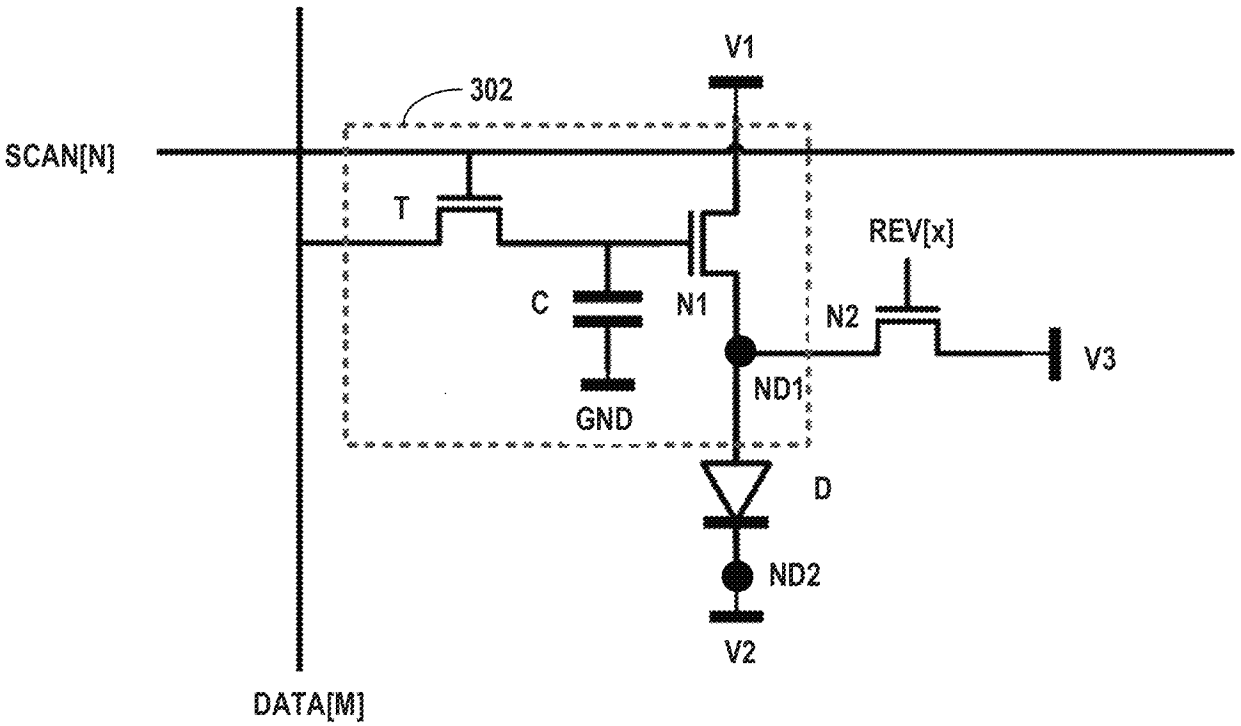
FIGS. 3A-3C are each a circuit diagram of an exemplary pixel circuit for driving a light emitting element in accordance with an embodiment.

FIG. 3A is a circuit diagram of a pixel circuit 300 for driving a light emitting element D in an array of OLEDs on display 102, according to an embodiment. For ease of illustration, light emitting element D is located in row N and column M of the array. A data signal DATA[M] and a scan signal SCAN[N] may be employed to control the light emission of the light emitting element D in a frame. For example, in each frame, when pixel circuit 300 receives scan signal SCAN[N], OLEDs in row N may be selected, and pixel circuit 300 may receive data signal DATA[M] to control the light emission of light emitting element D. Light emitting element D may be an OLED or a micro-OLED driven by pixel circuit 300. Pixel circuit 300 may include a pixel driver 302 configured to receive data signal DATA[M] and drive light emitting element D based on data signal DATA[M]. In some embodiments, the "ON" and "OFF" states of light emitting element D is determined based on data signal DATA[M]. For ease of illustration, in a first period of data signal DATA[M], light emitting element D is turned on; and in a second period of data signal DATA[M], light emitting element D is turned off. In the first period, light emitting element D may be turned on (e.g., forwardly biased) to emit light, and the brightness can range from a bright state to a dark state, depending on the value of data signal DATA[M]. In the second period, light emitting element D may be turned off and/or reversely biased, emitting little or no light. In the present disclosure, the first and second periods of data signal DATA[M] are employed to differentiate the "ON" (e.g., forwardly biased) and "OFF" (e.g., turned off and/or reversely biased) states of the light emitting element. The specific values of data signal DATA [M] should not be limited. In the present disclosure, "a first period" is interchangeable with "a first period of data signal," and "a second period" is interchangeable with "a second period of data signal."

As shown in FIG. 3A, pixel driver 302 may include a driving transistor N1 coupled to a first power signal V1 and light emitting element D. In some embodiments, driving transistor N1 is an n-type transistor, of which the drain terminal is coupled to first power signal V1 and the source terminal is coupled to light emitting element D. Pixel driver 302 may also include a capacitor C (e.g., storage capacitor), coupled to the gate terminal of driving transistor N1 at one terminal and coupled to the GND at the other terminal. Pixel driver 302 may further include a switch transistor T coupled to data signal DATA[M], scan signal SCAN[N], capacitor C, and driving transistor N1. Switch transistor T may allow data signal DATA[M] to be transmitted to driving transistor N1 when the row of light emitting element D is selected by scan signal [N] such that driving transistor N1 can be coupled to the anode of light emitting element D. In some embodiments, switch transistor T is an n-type transistor, of which the drain terminal is coupled to data signal DATA[M], the source terminal is coupled to capacitor C and the gate terminal of driving transistor N1, the gate terminal is coupled to scan signal SCAN[N].

The anode of light emitting element D may be coupled to the source terminal of driving transistor N1, which is coupled to first power signal V1. V1 may then be coupled to the anode of light emitting element D through driving transistor N1. The cathode of light emitting element D may be coupled to a second power signal V2. In some embodiments, when light emitting element D is turned on (e.g., to emit light) in a first period based on data signal DATA[M], the value of first power signal V1 is higher than the value of second power signal V2. In some embodiments, the value of first power signal V1 is equal to Vdd (e.g., a positive power supply voltage) and the value of second power signal V2 is equal to Vss (e.g., a negative power supply voltage). That is, when light emitting element D is turned on, a voltage $V_{DN1}$ at the anode of light emitting element D (e.g., at node ND1) may be higher than a voltage $V_{DN2}$ at the cathode of light emitting element D (e.g., at node ND2). Light emitting element D may be forwardly biased and driving current may flow into light emitting element D through driving transistor N1. In some embodiments, the value of first power signal V1 is an unchanged DC value, e.g., Vdd, in the first period. In some embodiments, first power signal V1 is an AC signal.

Pixel circuit 300 may include a third power signal V3 applied on the anode of light emitting element D in a second period, i.e., when the light emitting element D is turned off. That is, in the second period, voltage $V_{DN1}$ (e.g., at the anode of the light emitting element D) may be determined by third power signal V3 instead of first power signal V1. Meanwhile, in the second period, second power signal V2 may vary, e.g., increase, such that voltage $V_{DN2}$ at the cathode of the light emitting element D can be higher than voltage $V_{DN1}$. Accordingly, light emitting element D may be reversely biased in the second period. In some embodiments, third power signal V3 is coupled to the source terminal of driving transistor N1 and the anode of the light emitting element D. The value of third power signal V3 may be lower than the value of first power signal V1 (e.g., Vdd).

In some embodiments, second power signal V2 ranges from a minimum second power value and a maximum second power value. The minimum second power value may be equal to Vss. The maximum second power value may be a positive value, a negative value, or zero, depending on the value of third power signal V3. In some embodiments, third power signal V3 is an unchanged value, which can be a positive value, a negative value, or zero. In some embodiments, the reverse voltage applied across light emitting element D (i.e., (VDN2−VDN1)) is equal to (V3−V2). In some embodiments, the maximum second power value is greater than the value of third power signal V3. In some embodiments, the value of second power signal V2 is positive and the value of third power signal V3 is negative (e.g., Vss).

In some embodiments, the connection/coupling between third power signal V3 and pixel driver 302 (or node ND1) is controlled by a switch device N2, which controls the transmission of third power signal V3 to light emitting element D when light emitting element D is turned off (e.g., in a second period). In some embodiments, switch device N2 is an n-type transistor, of which the drain terminal is coupled to third power signal V3 and the source terminal is coupled to pixel driver 302 (or node ND1). The gate terminal of switch device N2 may be applied with a control signal REV[x], which turns on switch device N2 when light emitting element D is turned off (e.g., in a second period). In a first period, control signal REV[x] may be applied to turn off switch device N2 such that third power signal V3 applies no bias (or is decoupled) on pixel driver 302, voltage $V_{ND1}$ at the anode of light emitting element D may be (or determined by) the value of first power signal V1 (e.g., Vdd), and voltage $V_{ND2}$ at the cathode of light emitting element D may be the value of second power signal V2 (e.g., Vss). In a second period, control signal REV[x] may be applied to turn on switch device N2 such that third power signal V3 is coupled to pixel driver 302, voltage $V_{ND1}$ at the anode of light emitting element D may be (or determined by) the value of third power signal V3 (e.g., lower than Vdd), and voltage $V_{ND2}$ at the cathode of light emitting element D may be the value of second power signal V2 (e.g., higher than the value of third power signal V3). Control signal REV[x] may be generated using a separate circuit other than pixel circuit 300. In some embodiments, control signal REV[x] is generated based on data signal DATA[M] and/or scan signal SCAN[N].

In some embodiments, third power signal V3 may also vary between a maximum third power value and a minimum third power value. In some embodiments, the maximum third power value is lower than the maximum second power value. In various embodiments, the values of second and third power signals V2 and V3 may be flexibly determined based on the components of the circuit such as the light emitting element D and the power circuits that generate the power signals, and should not be limited by the embodiments of the present disclosure.

Figure 3B:
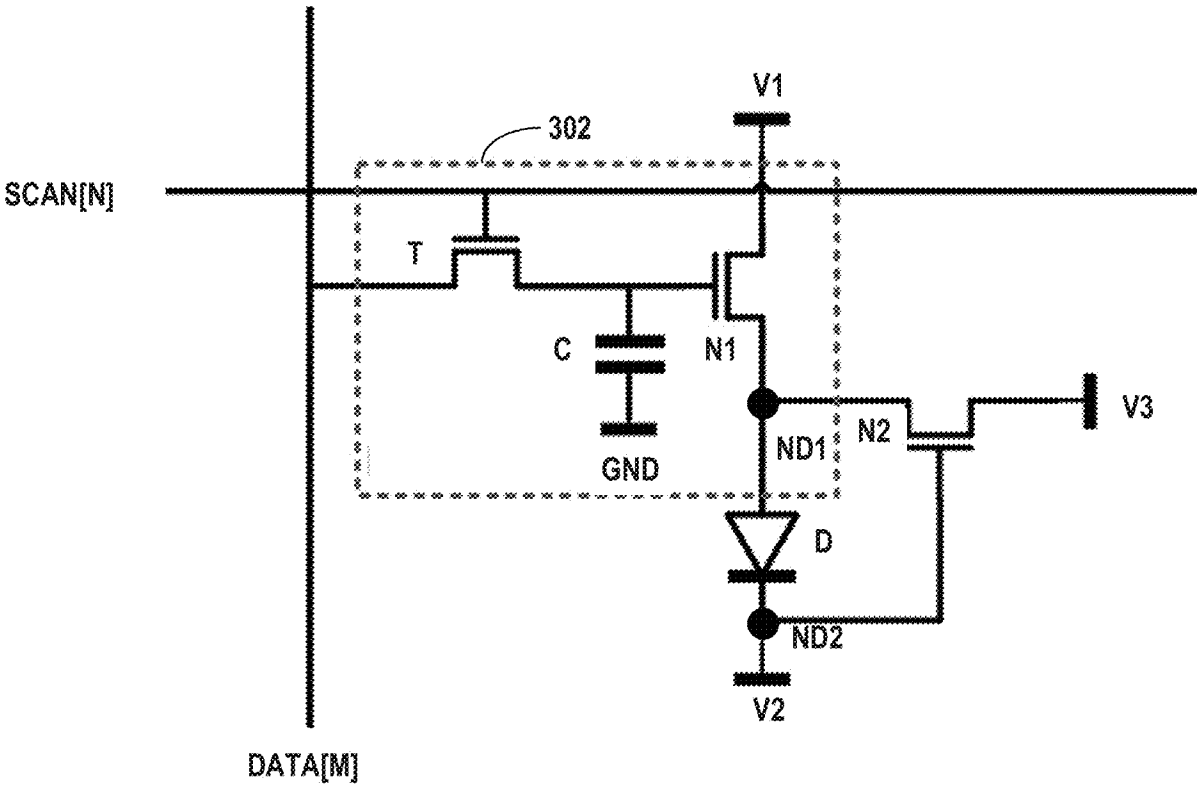

FIG. 3B is a circuit diagram of another pixel circuit 310 for driving a light emitting element D in an array of OLEDs on display 102, according to an embodiment. Different from pixel circuit 300, in pixel circuit 310, switch device N2 is controlled by second power signal V2 instead of control signal REV[x]. As shown in FIG. 3B, the gate terminal of switch device N2 is coupled to the cathode of light emitting element D (or node ND2). In a first period, first power signal V1 may be applied on the anode of the light emitting element D through driving transistor N1, and second power signal V2 may be applied on the cathode of the light emitting element D. The value of first power signal V1 may be higher than the value of second power signal V2. As described previously, in the first period, $V_{ND1}$ may be higher than $V_{ND2}$, and light emitting element D may be driven to emit light. In a first period, the value of second power signal V2 may be sufficiently low (e.g., a negative value such as Vss), and switch device N2 may be turned off to prevent third power signal V3 from applying a bias on pixel driver 302. In a second period, the value of second power signal V2 may increase to be sufficiently high to turn on switch device N2. Accordingly, third power signal V3 may be applied on the anode of the light emitting element D (or node ND1) through switch device N2, and first power signal V1 may not apply a bias on light emitting element D. Accordingly, as described previously, light emitting element D may be reversely biased in the second period. The ranges/values of second and third power signals V2 and V3, and the reverse voltage drop across light emitting element D in pixel circuit 310 may be the same as those of pixel circuit 300, and the detailed description is not repeated herein. In some embodiments, by controlling switch device N2 using second power signal V2, no additional control signal is needed for the controlling of switch device N2. For ease of description, control signal REV[x] may be referred to as an external control signal.

In some embodiments, in pixel circuits 300 and 310, the value of first power signal V1 may be reduced in the second period, e.g., when third power signal V3 is applied on the anode (or node ND1) of light emitting element D, to reduce or prevent electrical coupling, such as current, between first and third power signals V1 and V3. In some embodiments, first power signal V1 may be reduced to have the same value as third power signal V3 in the second period of data signal DATA[M].

Figure 3C:
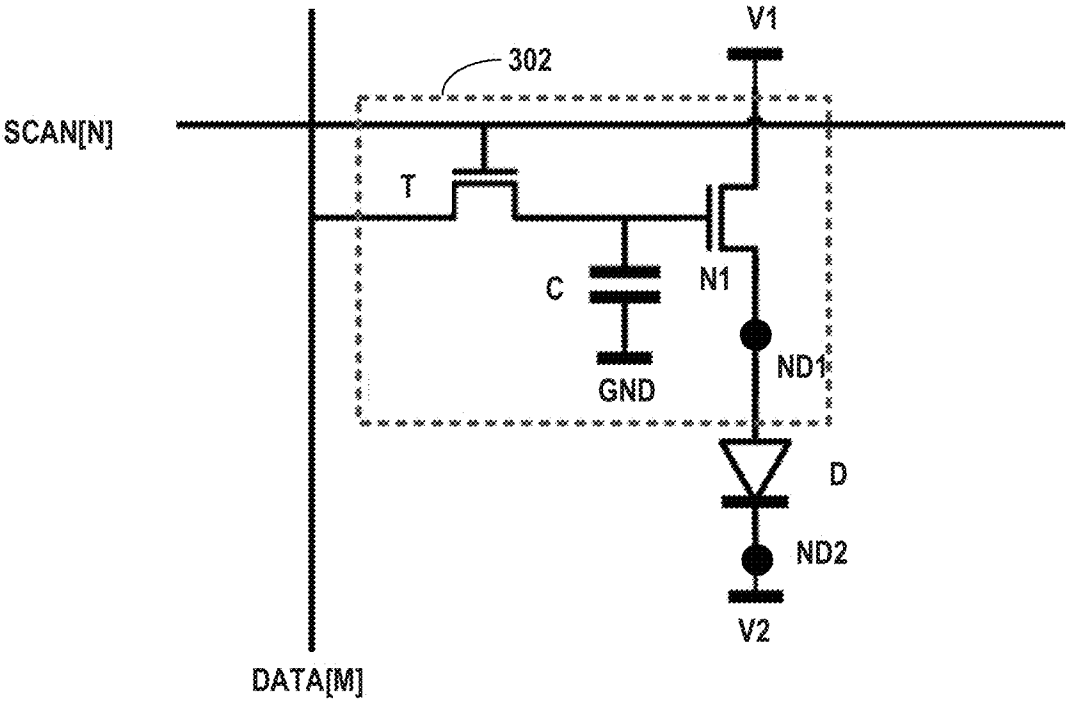

FIG. 3C is a circuit diagram of another pixel circuit 320 for driving a light emitting element D in an array of OLEDs on display 102, according to an embodiment. Different from pixel circuits 300 and 310, in pixel circuit 320, the value of first power signal V1 can vary for reverse bias function, e.g., decrease, based on data signal DATA[M], and light emitting element D is reversely biased by first and second power signals V1 and V2 in a second period. In this embodiment, light emitting element D is reversely biased by varying the values (and/or polarities) of first and second power signals V1 and V2. Similar to pixel circuits 300 and 310, in a first period, the value of first power signal V1 (e.g., Vdd) may be higher than the value of second power signal V2 (e.g., Vss), and light emitting element D may be driven to emit light. In a second period, the value of second power signal V2 may increase and the value of first power signal V1 may decrease, based on data signal DATA[M]. The value of second power signal V2 may be higher than the value of first power signal V1 in the second period. Accordingly, $V_{ND2}$ may be higher than $V_{ND1}$, and light emitting element D may be reversely biased. In some embodiments, first power signal V1 ranges between a minimum first power value and Vdd, where the minimum first power value is lower than Vdd. The minimum first power value can be a positive value, a negative value (e.g., Vss), or zero. In some embodiments, second power signal V2 ranges between Vss and a maximum second power value, similar to pixel circuits 300 and 310. The maximum second power value can be a positive value (e.g., Vdd), a negative value, or zero. In various embodiments, the reverse voltage drop across light emitting element D in a second period is nominally equal to (V1−V2) in the second period.

Figure 4A:
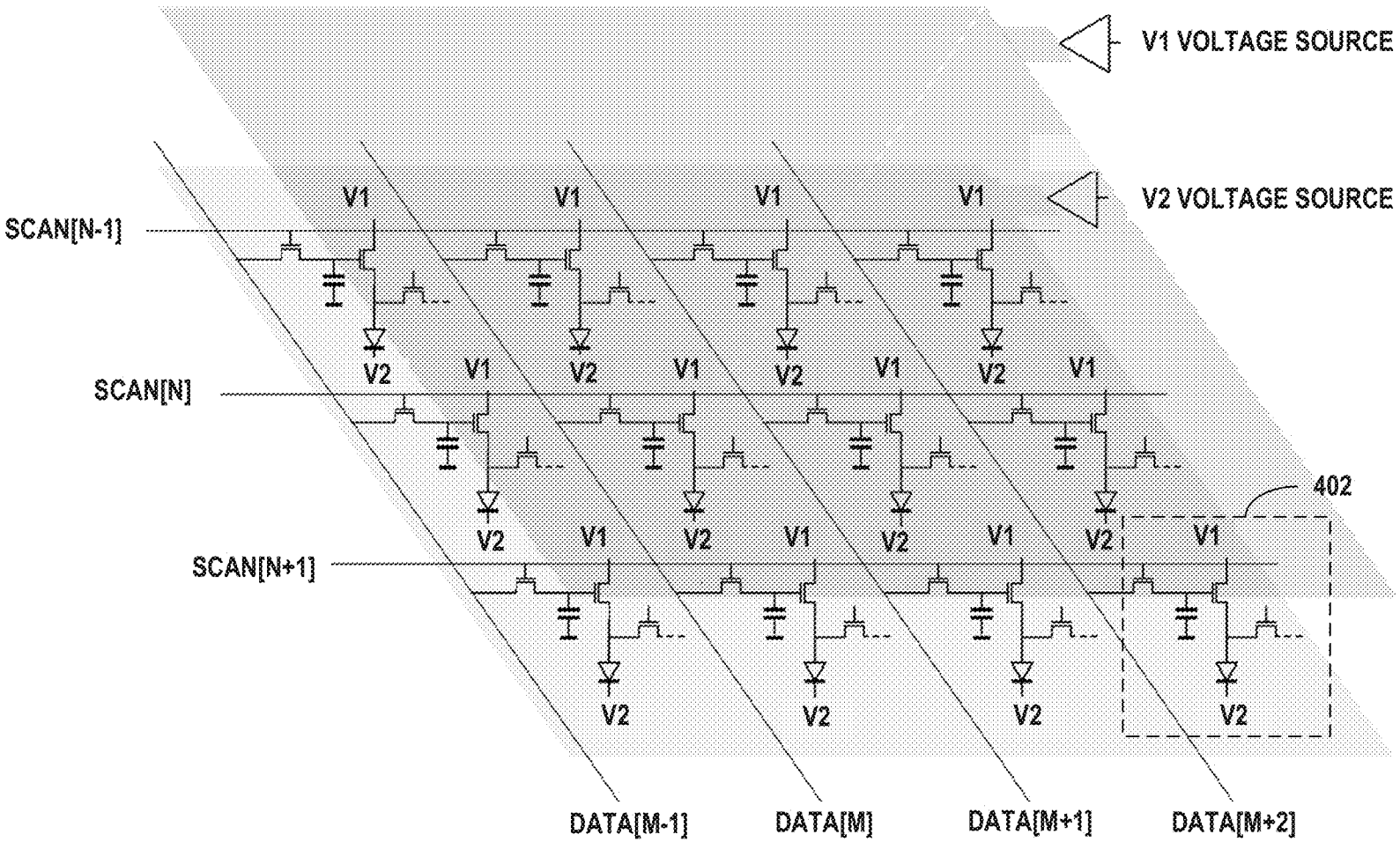
FIGS. 4A-4C are each a circuit diagram of an exemplary circuit for driving a plurality of light emitting elements in accordance with an embodiment.
Figure 4B:
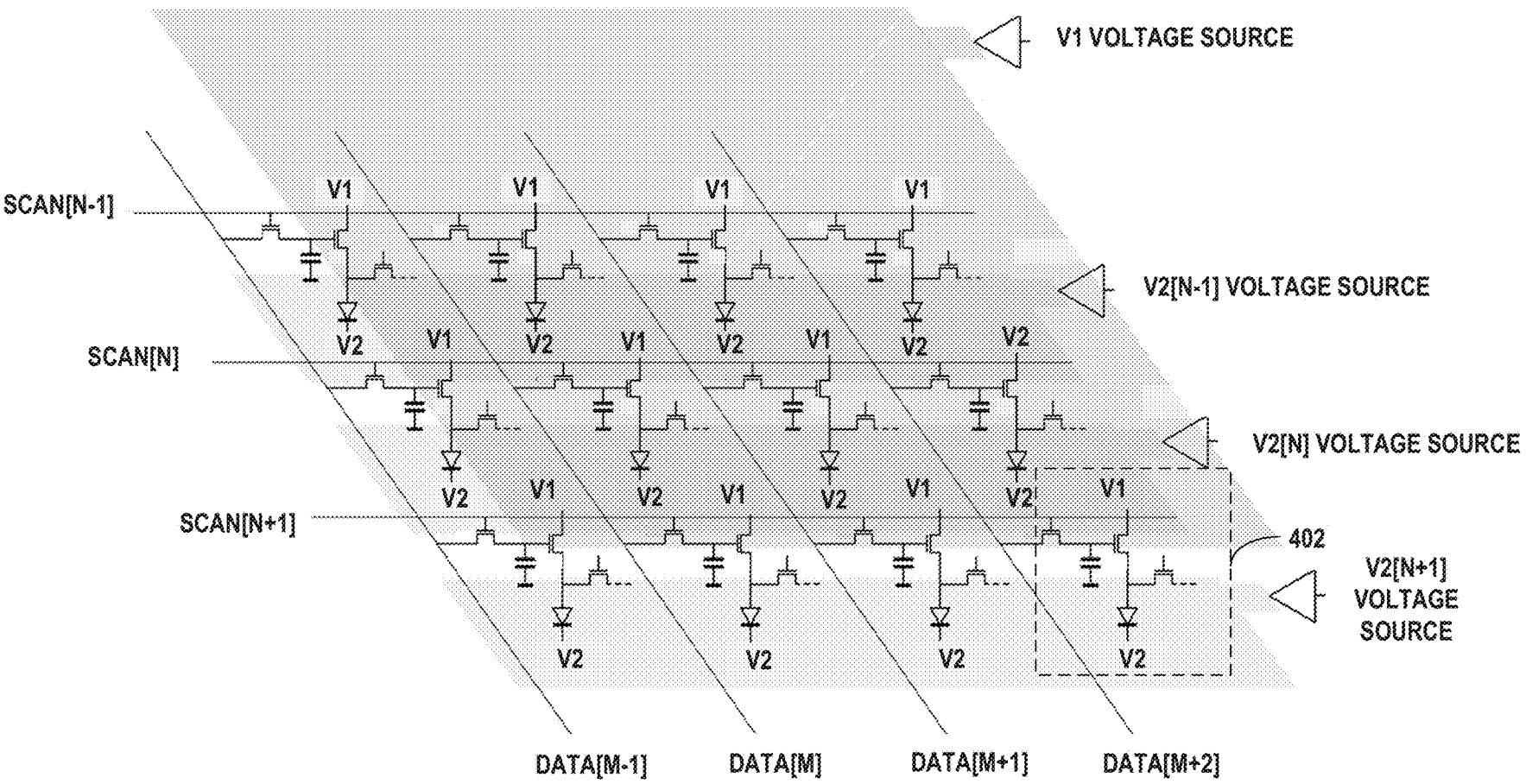
Figure 4C:
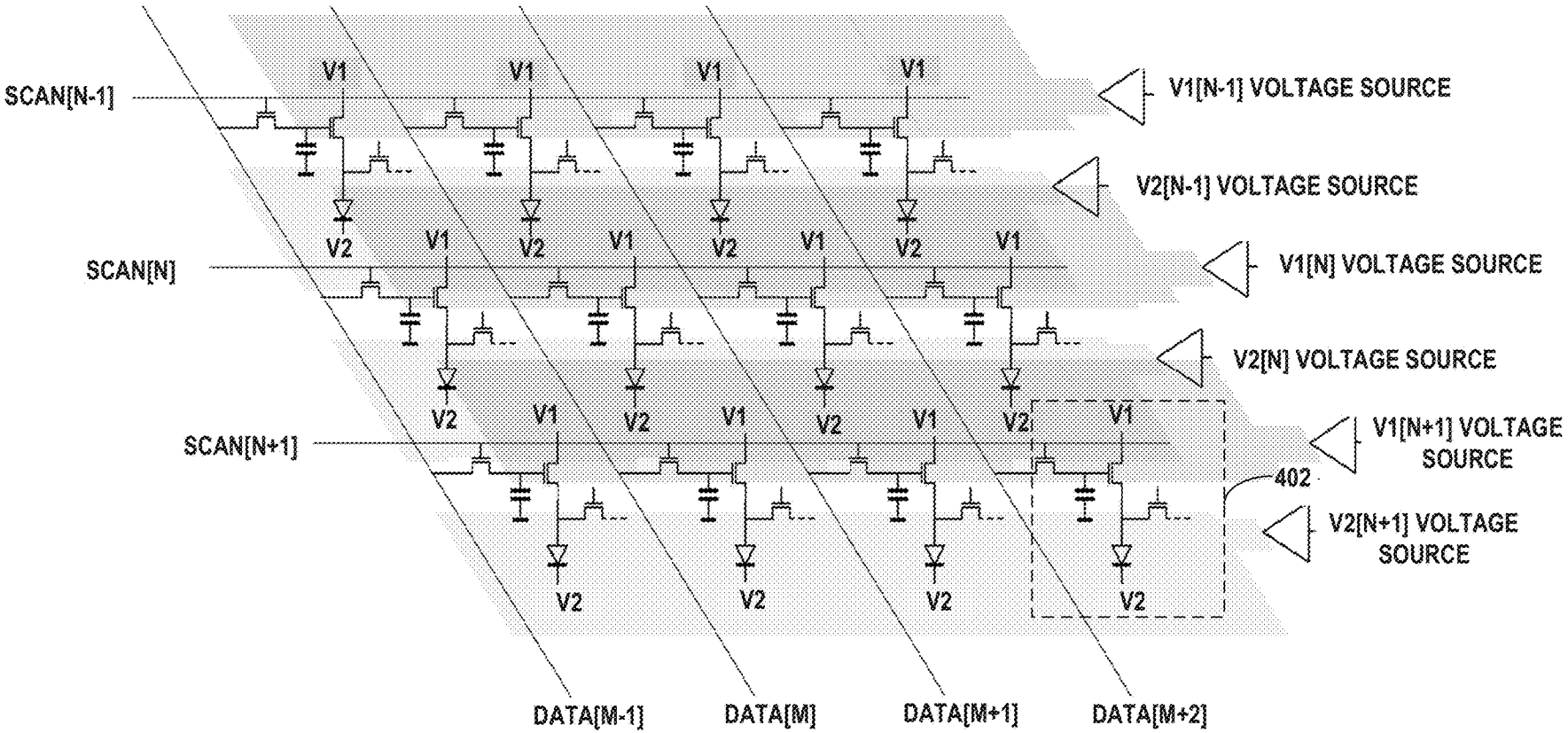

Display 102 may include a plurality of light emitting elements D arranged in an array of a plurality of rows and a plurality of columns. First and second power signals V1 and V2 may be applied to the light emitting elements D in different ways. FIGS. 4A-4C illustrate different circuits 400, 410, and 420, in which first and second power signals V1 and V2 are applied on the light emitting elements D in display 102. Circuits 400-420 may each include a plurality of light emitting elements D arranged in an array of a plurality of rows and a plurality of columns. Each light emitting element may be a part of a pixel circuit 402. A plurality of pixel circuits 402 may be arranged in the plurality of rows and the plurality of columns. In some embodiments, pixel circuit 402 may be similar to any one of pixel circuits 300-320, and the detailed description of pixel circuit 402 is thus not repeated herein. In some embodiments, circuits 400-420 may be employed to apply first and second power signals V1 and V2 in pixel circuits 300-320.

As shown in FIGS. 4A-4C, each scan line (e.g., SCAN[N−1], SCAN[N], SCAN[N+1], . . . ) may be coupled to a plurality of pixel circuits 402 along a row direction, and each data line (e.g., DATA[M−1], DATA[M], DATA[M+1], DATA[M+2], . . . ) may be coupled to a plurality of pixel circuits 402 along a column direction. First power signal V1 and second power signal V2 may each be applied on pixel circuits 402 in at least one row. In some embodiments, as shown in circuit 400, first power signal V1 and second power signal V2 may each be applied on each pixel circuit 402 in display 102 (i.e., arranged in a plurality of rows) through one respective voltage source (i.e., "V1 VOLTAGE SOURCE" and "V2 VOLTAGE SOURCE"). That is, the same first power signal V1 is applied on each pixel circuit 402 in display 102, and the same second power signal V2 is applied on each pixel circuit 402 in display 102. In other words, the control and/or operation of first power signal V1 may be the same time for all pixel circuits 402, and the control and/or operation of second power signal V2 may be the same time for all pixel circuits 402. In some embodiments, in circuit 400, pixel circuit 402 may include pixel circuits 300 and 310.

In some embodiments, as shown in circuit 410, the same first power signal V1 is applied on each pixel circuit 402, and a respective second power signal V2 (e.g., by V2[N−1]VOLTAGE SOURCE, V2[N] VOLTAGE SOURCE, V2[N+1] VOLTAGE SOURCE, . . . ) is applied on pixel circuits 402 in each row. That is, a number of V2 VOLTAGE SOURCEs (i.e., the number of second power signals V2) may be the same as a number of scan lines. Different from circuit 400, in circuit 410, second power signal V2 applied on each row may be operated and/or controlled separately, so that light emitting elements D in different rows may be reversely biased separately, e.g., at different times. The control of pixel circuits 402 may be more flexible. In some embodiments, in circuit 410, pixel circuit 402 may include pixel circuits 300 and 310.

In some embodiments, as shown in circuit 420, different from circuit 410, a respective first power signal V1 (e.g., by V1[N−1] VOLTAGE SOURCE, V1[N] VOLTAGE SOURCE, V1[N+1] VOLTAGE SOURCE, . . . ) is applied on pixel circuits 402 coupled to each row. That is, a number of V1 VOLTAGE SOURCEs (i.e., the number of first power signals V1) may be the same as a number of scan lines. Different from circuits 400 and 410, in circuit 420, first power signals V1 applied on each row may be operated and/or controlled separately, so that light emitting elements D in different rows may be reversely biased separately, e.g., at different times. The control of pixel circuits 402 may be more flexible. In some embodiments, in circuit 420, pixel circuit 402 may include pixel circuit 320.

Figure 5A:
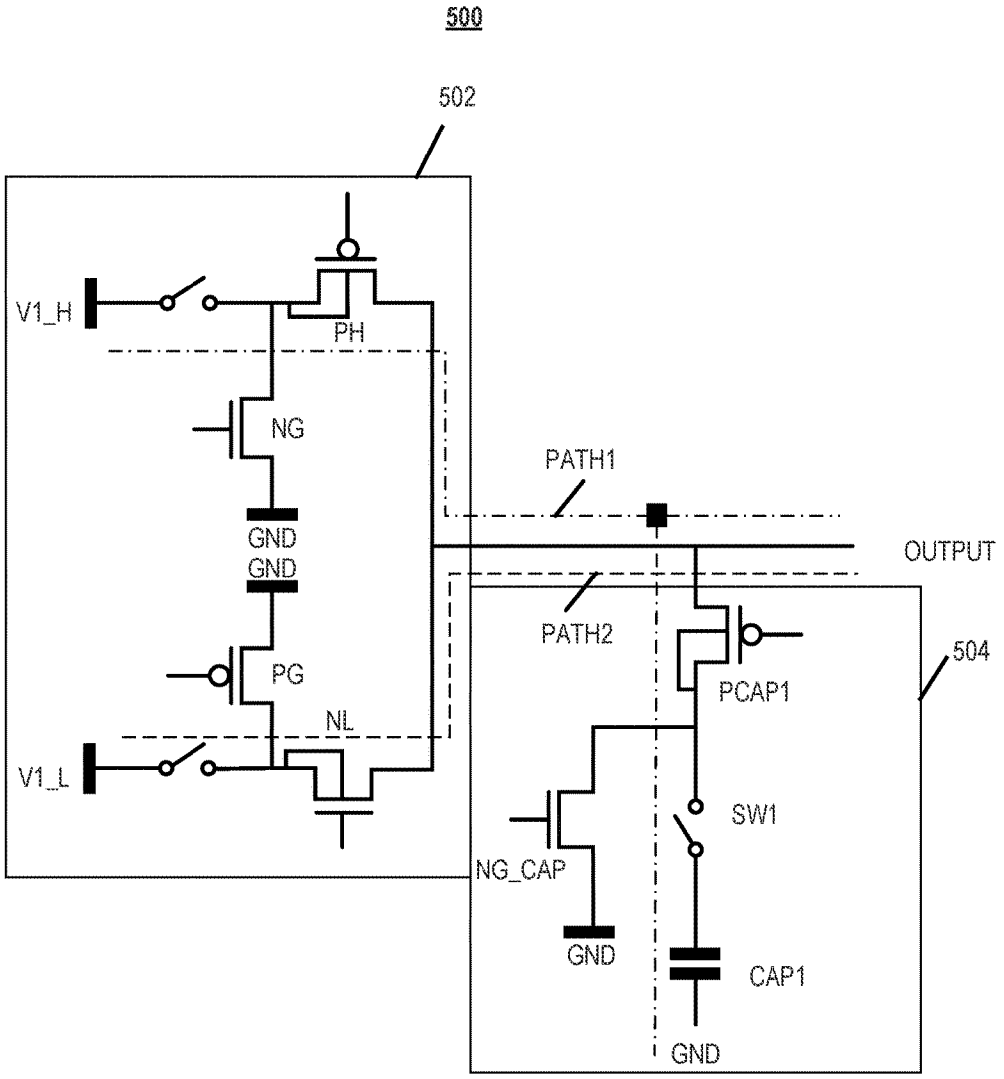
FIG. 5A is a circuit diagram of an exemplary circuit for generating a first AC power signal in accordance with an embodiment.
Figure 5B:
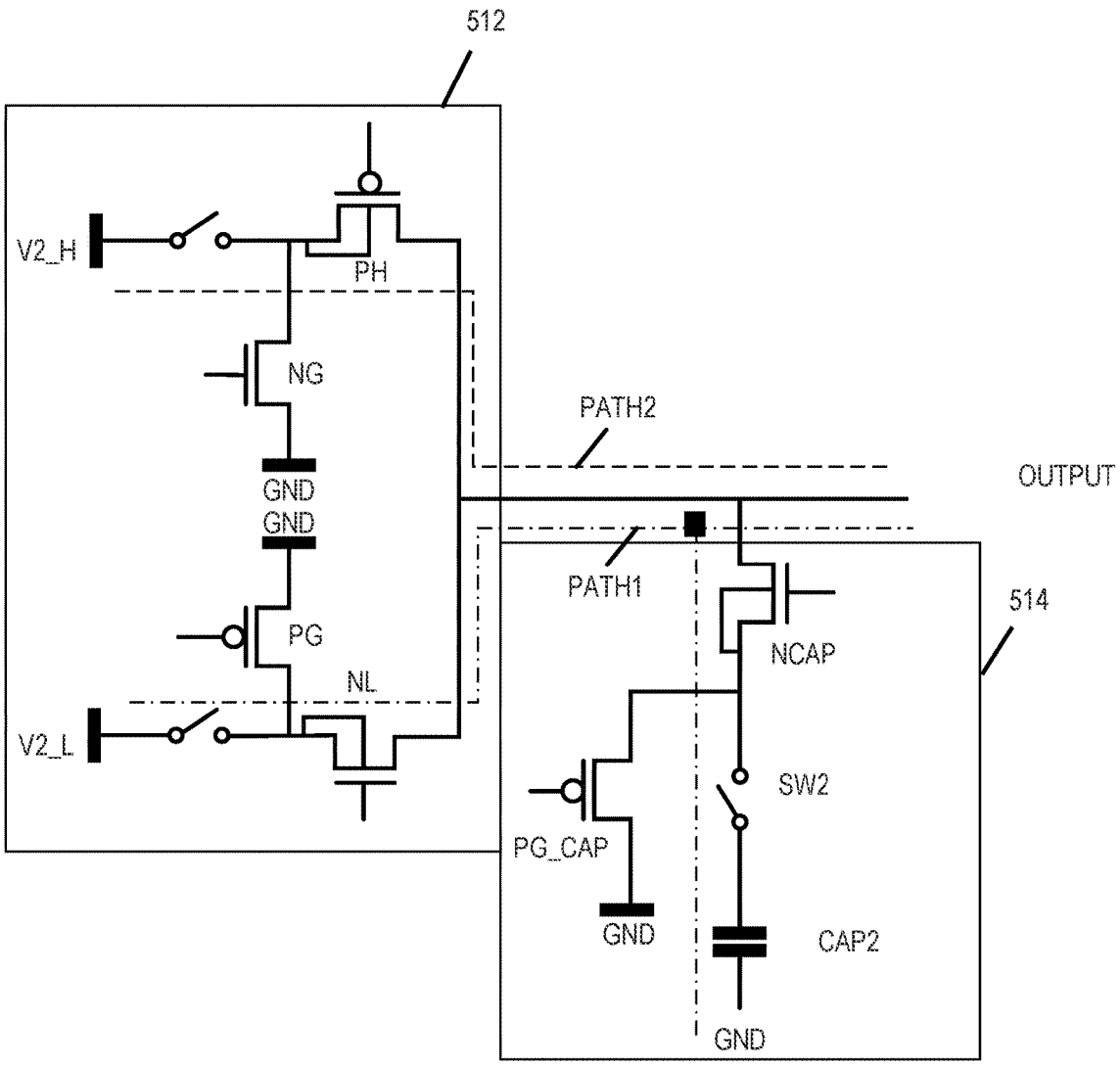
FIG. 5B is a circuit diagram of an exemplary circuit for generating a second AC power signal in accordance with an embodiment.

First and second power signals V1 and V2 may each be generated by a suitable AC power source circuit and be applied to respective pixel circuits. FIG. 5A illustrates an exemplary first power source circuit 500 for generating first power signal V1 (e.g., a first AC power signal) that ranges from a minimum first power value V1_L to a maximum first power value V1_H (e.g., Vdd). Power source circuit 500 may be employed for generating first power signal V1 for pixel circuit 320. FIG. 5B illustrates an exemplary power source circuit 510 for generating second power signal V2 (e.g., a second AC power signal) that ranges from a minimum second power value V2_L (e.g., Vss) to a maximum first power value. Power source circuit 510 may be employed for generating second power signal V2 for pixel circuits 300-320. Each of power source circuits 500 and 510 may include a power circuit (i.e., 502 and 512) and a switch circuit (i.e., 504 and 514) coupled to the respective power circuit. Each power circuit 502 and 512 may have a voltage swing between a respective maximum power value and a respective minimum power value. The structure and working mechanism of power circuits 502 and 512 may be found in Chinese Patent CN 101101736A, and the detailed description is omitted herein.

As shown in FIG. 5A, first power source circuit 500 may include a first power circuit 502 in contact with a first switch circuit 504. First power circuit 502 may provide AC power ranging between a maximum first power value V1_H (e.g., Vdd) and a minimum first power value V1_L (e.g., GND). Maximum and minimum first power values V1_H and V1_L may be supplied by respective power sources. Each power source may be coupled with a plurality of components such as transistors and/or capacitors (e.g., PH and NG, and NL and PG) and further coupled to GND. An output ("OUTPUT") of first power source circuit 500 may be coupled to V1_H and V1_L through any components (e.g., PH and NL), and is configured to output first power signal V1 with a voltage swing between V1_H and V1_L. In some embodiments, V1_H is equal to Vdd (e.g., a positive voltage), and V1_L is equal to GND (e.g., 0V). In some embodiments, Vdd>V1_H>GND, where Vdd is a positive voltage.

A first switch circuit 504 may be coupled (e.g., electrically coupled to or forming electrical coupling) to first power circuit 502 or may be decoupled (e.g., having little or no electrical coupling) from first power circuit 502, depending on the operation. In a first period, first switch circuit 504 may be coupled to first power circuit 502 and may filter out noisy signals when first power source circuit 500 outputs AC power signal (e.g., first power signal V1) for driving the respective light emitting element. In a second period, first switch circuit 504 may be decoupled from first power circuit 502 when first power source circuit 500 is used in reversely biasing the respective light emitting element. No noise filtering is performed in the second period. That is, in some embodiments, first power source circuit 500 only filters noisy signals for when light emitting elements are turned on. Compared to a conventional AC power source circuit that filters noisy signals when light emitting elements are turned on and off, energy can be conserved. For example, when first power source circuit 500 outputs V1_H, the respective light emitting element is forwardly biased and/or turned on, and first switch circuit 504 is coupled to first power circuit 502 to filter out noisy signals; and when first power source circuit 500 outputs V1_L, the respective light emitting element is reversely biased and/or turned off, and first switch circuit 504 is decoupled from first power circuit 502.

As shown in FIG. 5A, first switch circuit 504 may include a transistor PCAP1 coupled to first power circuit 502, a switch SW1 coupled to transistor PCAP1, a capacitor CAP1 coupled to switch SW1 and GND, and a transistor NG_CAP coupled to capacitor PCAP1, switch SW1, and GND. In some embodiments, transistor PCAP1 is a p-type transistor, of which the source terminal is coupled to first power circuit 502, the drain terminal is coupled to switch SW1, and the gate terminal is coupled to a control signal (i.e., VPCAP1_CTRL in FIG. 6A) that controls the "ON" and "OFF" states of transistor PCAPL. Switch SW1 may be coupled to transistor PCAP1 and one terminal of capacitor CAP1. The other terminal of capacitor CAP1 may be coupled to GND. In some embodiments, transistor NG_CAP is an n-type transistor, of which the drain terminal is coupled to the drain terminal of transistor PCAP1, the source terminal is coupled to GND, and the gate terminal is coupled to a control signal (i.e., VNGCAP_CTRL in FIG. 6A) that controls the "ON" and "OFF" states of transistor NG_CAP.

Figure 6A:
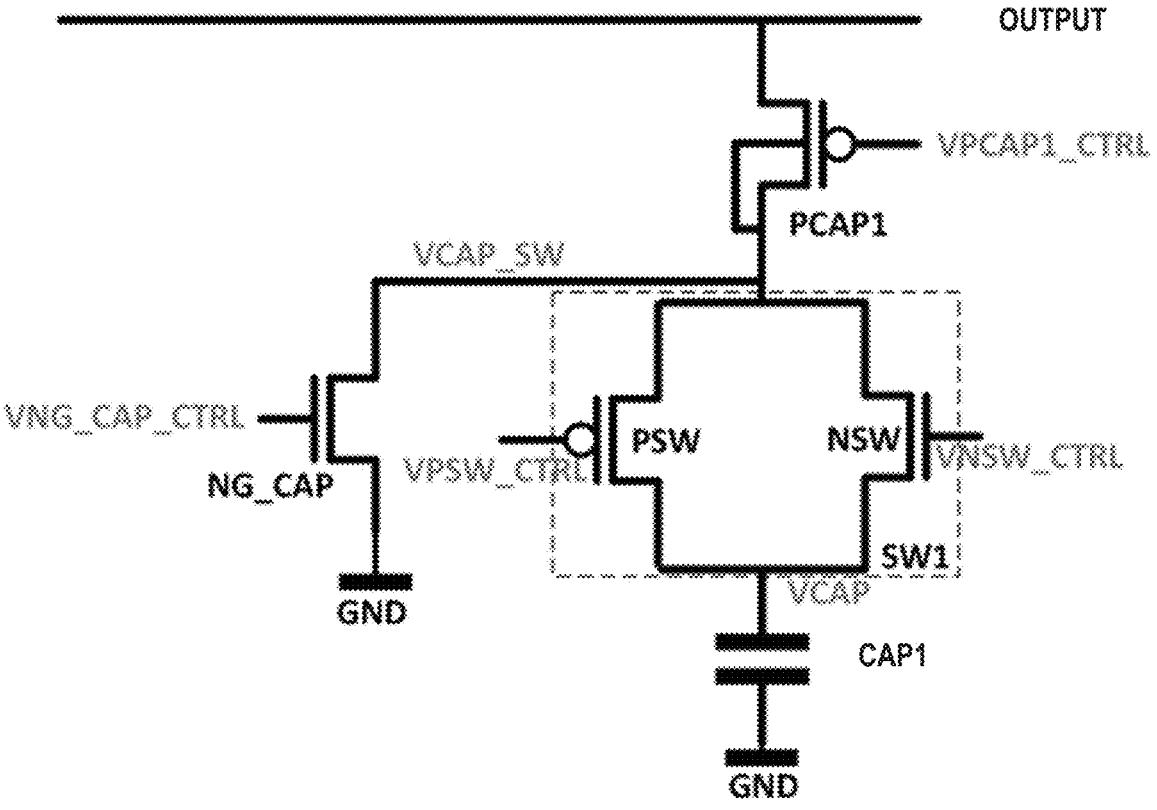
FIG. 6A is a circuit diagram of a first switch circuit in accordance with an embodiment.
Figure 6B:
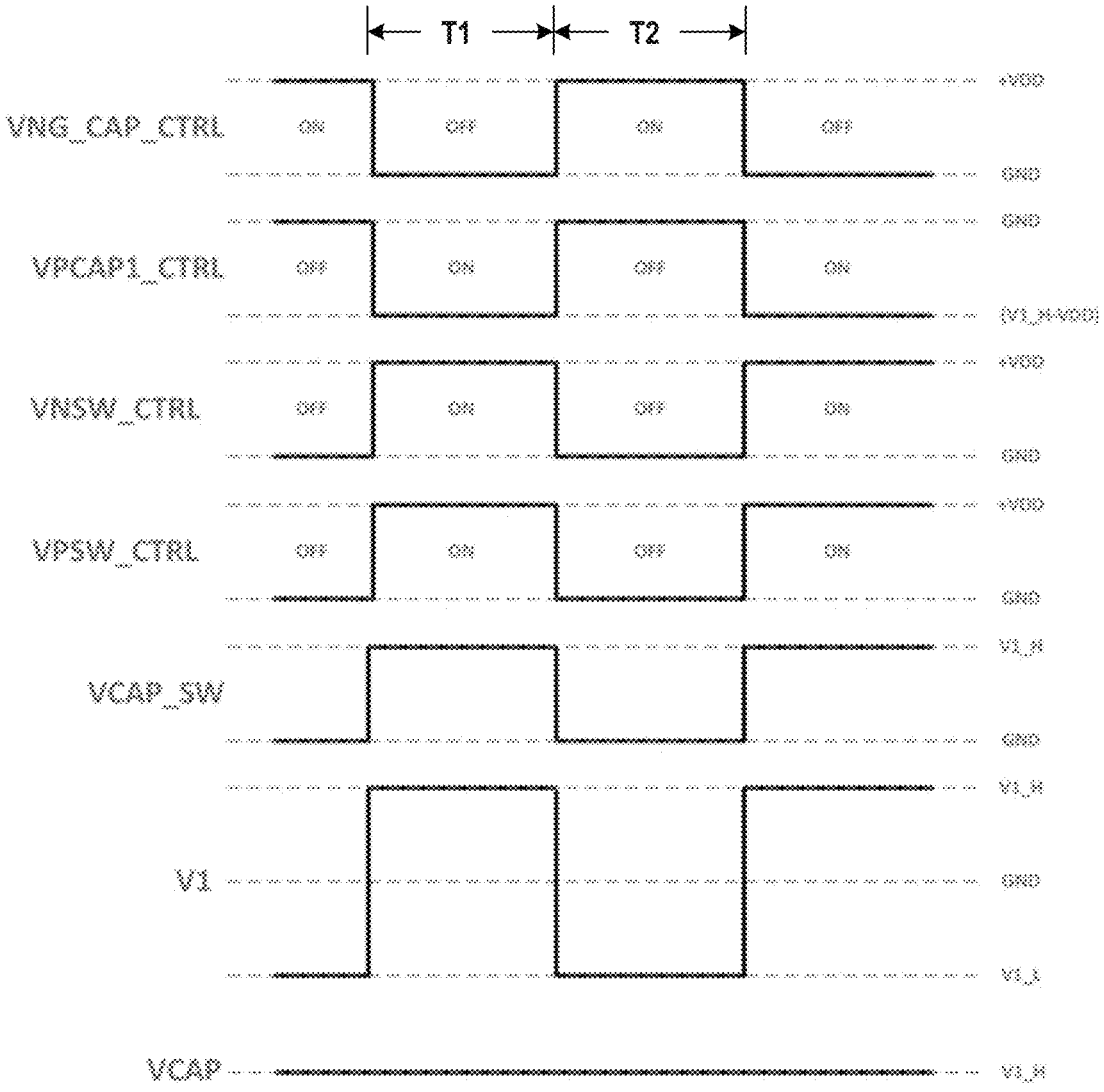
FIG. 6B is a timing diagram of the circuit illustrated in FIG. 6A in accordance with an embodiment.

FIG. 6A illustrates a detailed circuit diagram of first switch circuit 504, according to an embodiment. FIG. 6B illustrates a timing diagram of various voltages in first switch circuit 504. The operation of first power source circuit 500 is illustrated in view of FIGS. 5A, 6A, and 6B. As shown in FIG. 6A, switch SW1 may include a p-type transistor PSW and an n-type transistor NSW coupled together. In various embodiments, switch SW1 may include any suitable configuration and/or devices, not limited by the embodiments of the present disclosure. In some embodiments, a drain terminal of transistor NSW is coupled to a source terminal of transistor PSW and the drain terminal of transistor PCAP1, and a source terminal of transistor NSW is coupled to a drain terminal of transistor PSW and capacitor CAP1. A control signal VNSW_CTRL may be applied to a gate terminal of transistor NSW, and a control signal VPSW_CTRL may be applied to a gate terminal of transistor PSW. In some embodiments, a control signal VPCAP1_CTRL may be applied on the gate terminal of transistor PCAP1, and a control signal VNG_CAP_CTRL may be applied on the gate terminal of transistor NG_CAP. A voltage on one side (i.e., coupled to transistor PCAP1) of switch SW1 is represented by VCAP_SW, and a voltage on the other side (i.e., coupled to capacitor CAP1) of switch SW1 is represented by VCAP.

As shown in FIGS. 6A and 6B, in a first period T1, control signal VNG_CAP_CTRL may be configured to turn off transistor NG_CAP, control signal VPCAP1_CTRL may be configured to turn on transistor PCAP1, and control signals VNSW_CTRL and VPSW_CTRL may be configured to respectively turn on transistors NSW and PSW. Accordingly, switch SW1 is turned on, and voltages VCAP_SW and VCAP may both be equal to an output V1 (e.g., maximum first power value V1_H) of first power source circuit 500. Referring back to FIG. 5A, in first period T1, when switch SW1 and transistor PCAP1 are turned on and transistor NG_CAP is turned off, capacitor CAP1 is coupled to first power circuit 502. In some embodiments, capacitor CAP1 is employed for noise filtering, e.g., only in first period T1. In some embodiments, current in first power source circuit 500 flows through path 1, which includes the power source that supplies maximum first power value V1_H and capacitor CAP1. An output V1 of first power source circuit 500 may be equal to V1_H.

As shown in FIGS. 6A and 6B, in a second period T2, control signal VNG_CAP_CTRL may be configured to turn on transistor NG_CAP, control signal VPCAP1_CTRL may be configured to turn off transistor PCAP1, and control signals VNSW_CTRL and VPSW_CTRL may be configured to respectively turn off transistors NSW and PSW. Accordingly, switch SW1 is turned off, voltage VCAP_SW may be equal to GND, and voltage VCAP may be equal to maximum first power value V1_H of first power source circuit 500. Referring back to FIG. 5B, in second period T2, when switch SW1 and transistor PCAP1 are turned off and transistor NG_CAP is turned on, capacitor CAP1 is decoupled from first power circuit 502. In some embodiments, current in first power source circuit 500 flows through path 2, which includes the power source that supplies minimum first power value V1_L. An output V1 of first power source circuit 500 may be equal to V1_L.

FIG. 5B illustrates a second power source circuit 510. Similar to first power source circuit 500, second power source circuit 510 may include a second power circuit 512 coupled with a second switch circuit 514. Second power circuit 512 may provide AC power ranging between a maximum second power value V2_H (e.g., GND) and a minimum first power value V2_L (e.g., Vss). Maximum and minimum first power values V1_H and V1_L may be supplied by respective power sources. Each power source is coupled with a plurality of components such as transistors and/or capacitors (e.g., PH and NG, and NL and PG) and further coupled to GND. An output ("OUTPUT") of second power source circuit 510 may be coupled to V2_H and V2_L through any components (e.g., PH and NL), and is configured to output second power signal V2 with a voltage swing between V2_H and V2_L. In some embodiments, V2_H is equal to GND (e.g., 0 V), and V1_L is equal to Vss (e.g., a negative voltage). In some embodiments, GND>V2_L>Vss, where Vss is a negative voltage.

A second switch circuit 514 may be coupled to second power circuit 512 or may be decoupled from second power circuit 512, depending on the operation. In a first period, second switch circuit 514 may be coupled to second power circuit 512 and may filter out noisy signals when second power source circuit 510 outputs AC power signal (e.g., second power signal V2) for driving the respective light emitting element. In a second period, second switch circuit 514 may be decoupled from second power circuit 512 when second power source circuit 510 is used in reversely biasing the respective light emitting element. No noise filtering is performed in the second period. That is, in some embodiments, second power source circuit 510 only filters noisy signals for when light emitting elements are turned on. Similar to first power source circuit 500, energy can be conserved by using second power source circuit 510. For example, when second power source circuit 510 outputs V2_L, the respective light emitting element is forwardly biased and/or turned on, and second switch circuit 514 is coupled to second power circuit 512 to filter out noisy signals; and when second power source circuit 510 outputs V2_H, the respective light emitting element is reversely biased and/or turned off, and second switch circuit 514 is decoupled from second power circuit 512.

As shown in FIG. 5B, second switch circuit 514 may include a transistor NCAP coupled to second power circuit 512, a switch SW2 coupled to transistor NCAP, a capacitor CAP2 coupled to switch SW2 and GND, and a transistor PG_CAP coupled to capacitor NCAP, switch SW2, and GND. In some embodiments, transistor NCAP is an n-type transistor, of which the drain terminal is coupled to second power circuit 512, the source terminal is coupled to switch SW2, and the gate terminal is coupled to a control signal (i.e., VNCAP_CTRL in FIG. 6B) that controls the "ON" and "OFF" states of transistor NCAP. Switch SW2 may be coupled to transistor NCAP and one terminal of capacitor CAP2. The other terminal of capacitor CAP2 may be coupled to GND. In some embodiments, transistor PG_CAP is a p-type transistor, of which the source terminal is coupled to the source terminal of transistor NCAP, the drain terminal is coupled to GND, and the gate terminal is coupled to a control signal (i.e., VPGCAP_CTRL in FIG. 6B) that controls the "ON" and "OFF" states of transistor PG_CAP.

Figure 7A:
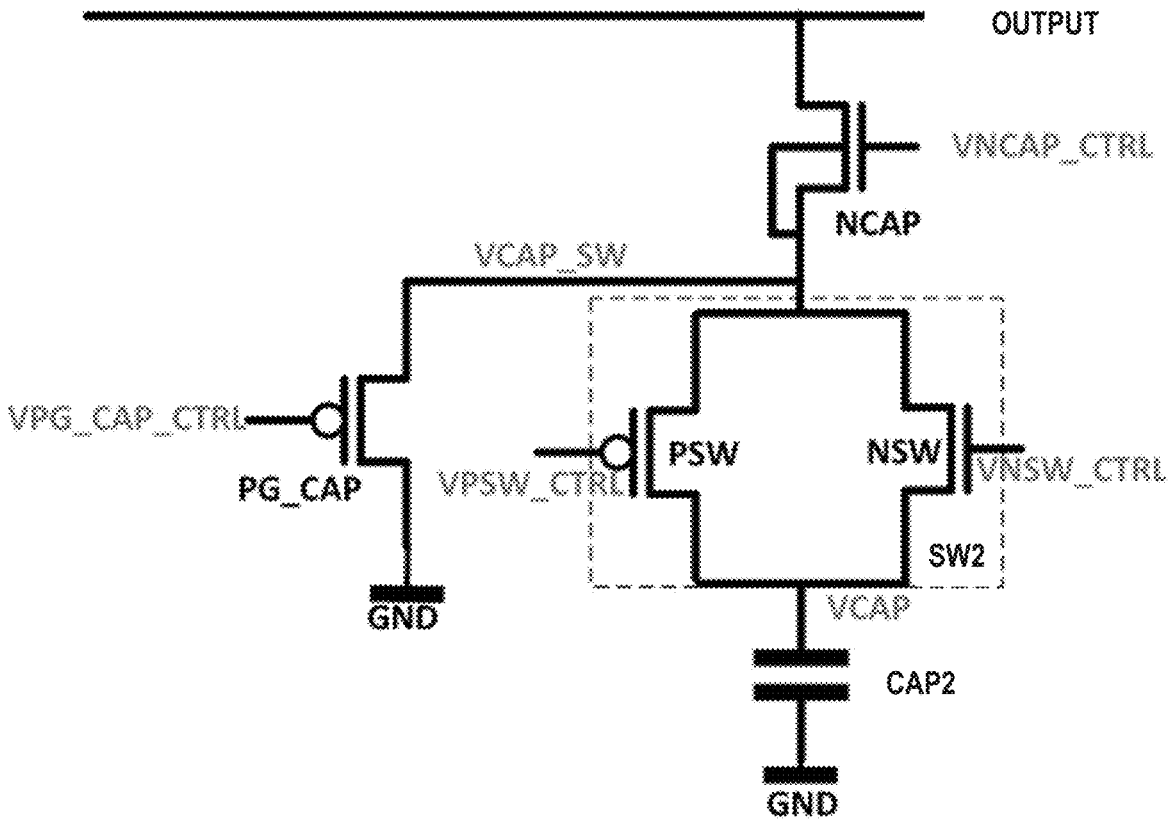
FIG. 7A is a circuit diagram of a second switch circuit in accordance with an embodiment.
Figure 7B:
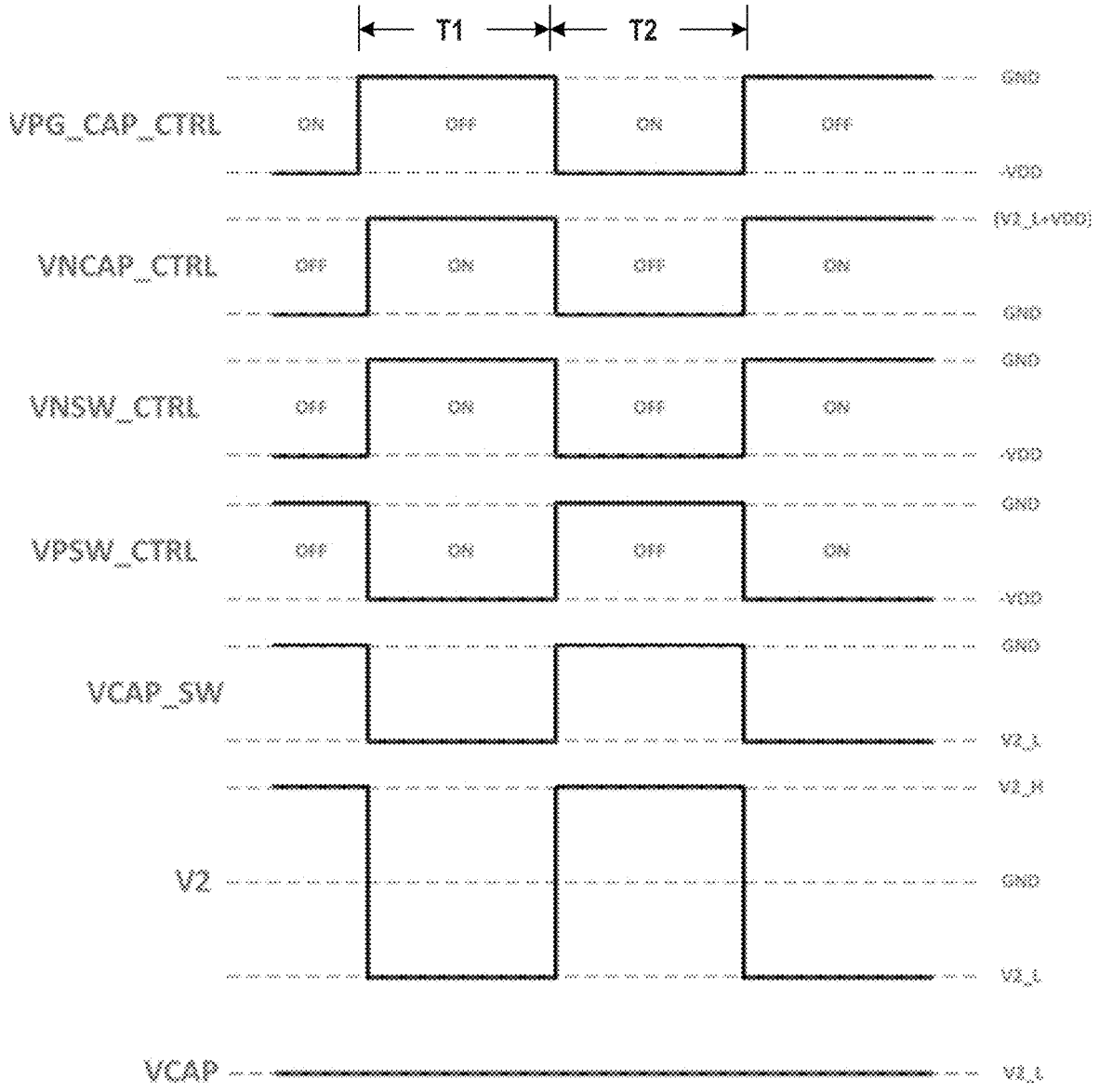
FIG. 7B is a timing diagram of the circuit illustrated in FIG. 7A in accordance with an embodiment.

FIG. 7A illustrates a detailed circuit diagram of second switch circuit 514, according to an embodiment. FIG. 7B illustrates a timing diagram of various voltages in second switch circuit 514. The operation of second power source circuit 510 is illustrated in view of FIGS. 5B, 7A, and 7B. As shown in FIG. 7A, switch SW2 may include a p-type transistor PSW and an n-type transistor NSW coupled together, similar to first switch circuit 504. In some embodiments, a drain terminal of transistor NSW is coupled to a source terminal of transistor PSW and the source terminal of transistor NCAP, and a source terminal of transistor NSW is coupled to a drain terminal of transistor PSW and capacitor CAP2. In some embodiments, a control signal VNCAP_CTRL may be applied on the gate terminal of transistor NCAP, and a control signal VPG_CAP_CTRL may be applied on the gate terminal of transistor PG_CAP. A voltage on one side (i.e., coupled to transistor NCAP) of switch SW2 is represented by VCAP_SW, and a voltage on the other side (i.e., coupled to capacitor CAP2) of switch SW2 is represented by VCAP.

As shown in FIGS. 7A and 7B, in a first period T1, control signal VPG_CAP_CTRL may be configured to turn off transistor PG_CAP, control signal VNCAP_CTRL may be configured to turn on transistor NCAP, and control signals VNSW_CTRL and VPSW_CTRL may be configured to respectively turn on transistors NSW and PSW. Accordingly, switch SW2 is turned on, and voltages VCAP_SW and VCAP may both be equal to an output V2 (e.g., minimum second power value V2_L) of second power source circuit 510. Referring back to FIG. 5B, in first period T1, when switch SW2 and transistor NCAP are turned on and transistor PG_CAP is turned off, capacitor CAP2 is coupled to second power circuit 512. In some embodiments, capacitor CAP2 is employed for noise filtering, e.g., only in first period T1. In some embodiments, current in second power source circuit 510 flows through path 1, which includes the power source that supplies minimum second power value V2_L and capacitor CAP2. An output V2 of second power source circuit 510 may be equal to V2_L.

As shown in FIGS. 7A and 7B, in a second period T2, control signal VPG_CAP_CTRL may be configured to turn on transistor PG_CAP, control signal VNCAP_CTRL may be configured to turn off transistor NCAP, and control signals VNSW_CTRL and VPSW_CTRL may be configured to respectively turn off transistors NSW and PSW. Accordingly, switch SW2 is turned off, voltage VCAP_SW may be equal to GND, and voltage VCAP may be equal to minimum second power value V2_L of second power source circuit 510. Referring back to FIG. 7B, in second period T2, when switch SW2 and transistor NCAP are turned off and transistor PG_CAP is turned on, capacitor CAP2 is decoupled from second power circuit 512. In some embodiments, current in second power source circuit 510 flows through path 2, which includes the power source that supplies maximum second power value V2_H. An output V2 of second power source circuit 510 may be equal to V2_H.

In some embodiments, first power source circuit 500 is employed to provide first power signal V1, ranging between maximum first power value V1_H (e.g., Vdd) and minimum first power value V1_L (e.g., GND), to circuit 420. In some embodiments, second power source circuit 510 is employed to provide second power signal V2, ranging between maximum second power value V2_H (e.g., GND) and minimum second power value V2_L (e.g., Vss), to circuits 400, 410, and 420.

In some embodiments, for circuits 400 and 410, first power signal V1 is provided in a first period (T1) and third power signal V3 is provided in a second period (T2). In some embodiments, first and third power signals V1 and V3 are each provided by a suitable power circuit. In some embodiments, the value of first power signal V1 is Vdd and the value of third power signal V3 is lower than Vdd. Second power source circuit 510 may provide second power signal V2 in both first and second periods, while in the first period, the value of second power signal V2 is lower than the value of first power signal V1, and in the second period, the value of second power signal V2 is higher than the value of third power signal V3. In some embodiments, second power source circuit 510 outputs Vss in the first period, and outputs a positive voltage, such as Vdd, in the second period.

In some embodiments, for circuit 420, first and power signals V1 and V2 are provided in both first and second periods (T1 and T2). In some embodiments, first power signal V1 is provided by first power source circuit 500 and second power signal V2 is provided by second power source circuit 510. Specifically, in the first period, first power source circuit 500 outputs a positive voltage as first power signal V1, and second power source circuit 510 outputs a negative voltage or zero as second power signal V2. In the second period, first power source circuit 500 outputs a negative voltage or zero as first power signal V1, and second power source circuit 510 outputs a positive voltage as second power signal V2. In some embodiments, first power source circuit 500 outputs Vdd in the first period and Vss in the second period, and second power source circuit 510 outputs Vss in the first period and Vdd in the second period.

For circuit 420, in the first period T1, first and second power source circuits 500 and 510 may together output a sufficiently high driving voltage across the light emitting element. In some embodiments, the maximum value of the driving voltage may be equal to (V1_H−V2_L). For example, V1_H may be equal to 5V, V2_L may be equal to (−5V), and the maximum driving voltage can be equal to 10V. That is, first and second power source circuits 500 and 510 can be combined to drive a light emitting element that requires a driving voltage higher than the individual driving voltage provided by each of first and second power source circuits 500 and 510. In some embodiments, in the second period, first and second power source circuits 500 and 510 may be combined to determine the reverse voltage drop across the light emitting element. Because each of first and second power source circuits 500 and 510 has a respective voltage swing range, the determination of the reverse voltage drop may be easier and more flexible.

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure or the appended claims in any way.

While the present disclosure has been described herein with reference to exemplary embodiments for exemplary fields and applications, it should be understood that the present disclosure is not limited thereto. Other embodiments and modifications thereto are possible, and are within the scope and spirit of the present disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments may perform functional blocks, steps, operations, methods, etc. using orderings different than those described herein.

The breadth and scope of the present disclosure should not be limited by any of the above-described exemplary embodiments, but should be defined only in accordance with the following claims and their equivalents.

What is claimed is:

1. A pixel circuit, comprising:

a pixel driver configured to receive a data signal and drive a light emitting element based on the data signal;

a first power signal coupled to an anode of the light emitting element through the pixel driver;

a second power signal coupled to a cathode of the light emitting element; and a third power signal coupled to the light emitting element, a value of the third power signal being lower than a positive power supply voltage, wherein:

the second power signal is configured to vary based on the data signal, in a first period of the data signal, a value of the second power signal is configured to be lower than a value of the first power signal, and in a second period of the data signal, the value of the first power signal is equal to the value of the third power signal and the value of the second power signal is configured to be higher than the value of the first power signal.

2. The pixel circuit of claim 1, wherein:

in the first period of the data signal, the light emitting element is configured to emit light; and in the second period of the data signal, the light emitting element is configured to be reversely biased.

3. The pixel circuit of claim 2, wherein in the second period of the data signal, the value of the second power signal is configured to increase to be higher than the value of the first power signal.

4. The pixel circuit of claim 3, wherein:

in the first period of the data signal, the value of the first power signal is equal to Vdd and the value of the second power signal is equal to Vss.

5. The pixel circuit of claim 2, wherein the first power signal is configured to vary between a minimum first power value and Vdd based on the data signal;

in the first period of the data signal, the value of the first power signal is equal to Vdd and the value of the second power signal is equal to a negative power supply voltage; and in the second period of the data signal, the value of the first power signal is configured to decrease such that the value of the second power signal is higher than the value of the first power signal.

6. The pixel circuit of claim 5, wherein in the second period of the data signal, the value of the first power signal is configured to decrease to Vss and the value of the second power signal is configured to increase to the positive power supply voltage.

7. The pixel circuit of claim 1, wherein:

the second power signal varies between a negative power supply voltage and a maximum second power value; and the maximum second power value is greater than the value of the third power signal.

8. The pixel circuit of claim 1, further comprising a switch device coupled between the third power signal and the anode of the light emitting element, and a control signal applied on the switch device, wherein in the second period of the data signal, the control signal is configured to turn on the switch device such that the first power signal applies no bias on the light emitting element, and the third power signal is coupled to the anode of the light emitting element.

9. The pixel circuit of claim 8, wherein the switch device is a transistor, a drain terminal of the transistor being coupled to the third power signal, a source terminal of the transistor being coupled to the cathode of the light emitting element, and the control signal being an external control signal applied on a gate terminal of the transistor.

10. The pixel circuit of claim 8, wherein the switch device is a transistor, a drain terminal of the transistor being coupled to the third power signal, a source terminal of the transistor being coupled to the cathode of the light emitting element, and the control signal being the second power signal applied on a gate terminal of the transistor.

11. A circuit for driving a plurality of light emitting elements, comprising:

a plurality of pixel circuits, each of the plurality of pixel circuits configured to drive one of a plurality of light emitting elements arranged in a plurality of rows and a plurality of columns and comprising:

a pixel driver configured to receive a data signal and drive a light emitting element based on the data signal;

a first power signal coupled to an anode of the light emitting element through the pixel driver;

a second power signal coupled to a cathode of the light emitting element; and a third power signal coupled to the light emitting element, a value of the third power signal being lower than a positive power supply voltage, wherein:

the second power signal is configured to vary based on the data signal, in a first period of the data signal, a value of the second power signal is lower than a value of the first power signal, and in a second period of the data signal, the value of the first power signal is equal to the value of the third power signal and the value of the second power signal is higher than the value of the first power signal.

12. The circuit of claim 11, wherein the second power signal is coupled to the cathode of each one of the plurality of light emitting elements arranged in the same row.

13. The circuit of claim 11, wherein the first power signal is coupled to the anode of each one of the plurality of light emitting elements arranged in the same row.

14. The circuit of claim 11, wherein the second power signal is coupled to the cathode of each one of the plurality of light emitting elements arranged in the plurality of rows and the plurality of columns, and the first power signal is coupled to the anode of each one of the plurality of light emitting elements arranged in the plurality of rows and the plurality of columns.

15. The pixel circuit of claim 11, further comprising a switch device coupled to the third power signal and the light emitting element, and a control signal applied on the switch device, wherein in the second period of the data signal, the control signal is configured to turn on the switch device such that the first power signal applies no bias on the light emitting element and the third power signal is coupled to the anode of the light emitting element.

16. The pixel circuit of claim 11, wherein:

the first power signal is configured to vary based on the data signal;

in the first period of the data signal, the value of the first power signal is equal to Vdd and the value of the second power signal is equal to a negative power supply voltage; and in the second period of the data signal, the value of the first power signal is configured to decrease such that the value of the second power signal is higher than the value of the first power signal.

17. A circuit for driving a light emitting element, comprising:

an alternating current (AC) power source circuit comprising a first power circuit configured to output a first power signal and a second power circuit configured to output a second power signal, wherein:

the first power signal ranges between a first high power value and a first low power value, the first high power value being greater than the first low power value, the first high and low power values being equal to or greater than zero;

the second power signal ranges between a second high power value and a second low power value, the second high power value being greater than the second low power value, the second high and low power values being lower than or equal to zero; and a power swing value of the AC power source circuit is equal to a difference between the first high power value and the second low power value, the difference being equal to or greater than a driving voltage across the light emitting element.

18. The circuit of claim 17, further comprising a first switch circuit coupled to the first power circuit and a second switch circuit coupled to the second power circuit, wherein:

the first switch circuit comprises a first capacitor, and the second switch circuit comprises a second capacitor;

in response to the first power circuit outputting the first high power value, the first capacitor is configured to be coupled to the first power circuit through a switch; and in response to the second power circuit outputting the second low power value, the second capacitor is configured to be coupled to the second power circuit through another switch.

19. The circuit of claim 18, wherein in response to the first power circuit outputting the first low power value, the first capacitor is configured to be decoupled from the first power circuit through the switch; and in response to the second power circuit outputting the second high power value, the second capacitor is configured to be decoupled from the second power circuit through the other switch.

* * * * *